United States Patent [19]

Blahna et al.

[11] 4,374,866

[45] Feb. 22, 1983

[54] METHOD OF MANUFACTURING CORRECTION FILTER FOR EXPOSING SCREENS OF COLOR-PICTURE TUBES

[75] Inventors: Nadezda Blahna, Lichtenwald; Bruno Fischer, Esslingen, both of Fed. Rep. of Germany

[73] Assignee: International Standard Electric Corporation, New York, N.Y.

[21] Appl. No.: 283,327

[22] Filed: Jul. 15, 1981

[30] Foreign Application Priority Data

Jul. 22, 1980 [DE] Fed. Rep. of Germany ..... 3027704

[51] Int. Cl.[3] ..... B05D 1/02; B05B 12/06

[52] U.S. Cl. ..... 427/10; 427/68; 427/110; 427/164; 427/168

[58] Field of Search ..... 427/10, 68, 110, 164, 427/168

[56] References Cited

U.S. PATENT DOCUMENTS 3,773,541 1/1973 Ng et al. ..... 427/10

*Primary Examiner*—James R. Hoffman

*Attorney, Agent, or Firm*—John T. O'Halloran; Peter C. Van Der Sluys

[57] ABSTRACT

To obtain the desired light-intensity distribution in lighthouses for exposing color-picture-tube screens, use is made of light filters. The filter disclosed is obtained by spraying droplets of an opaque paint onto a suitable transparent support.

13 Claims, 4 Drawing Figures

METHOD OF MANUFACTURING CORRECTION FILTER FOR EXPOSING SCREENS OF COLOR-PICTURE TUBES

The present invention relates to a correction filter with a light-absorbing transmission pattern for generating, during the photochemical manufacture of the screen of a color-picture tube, an exposure level distributed over an area in a predetermined manner.

During the manufacture of color-picture tubes, the continuous phosphor coating on the screen is exposed through a shadow mask with a UV light source, which exposure causes a chemical reaction that results in the exposed phosphor areas adhering to the glass faceplate panel.

To deposit the phosphor areas where they can be struck by the electrons passing through the apertures of the shadow mask during tube operation, a lens is interposed between the light source and the shadow mask to substitute the light paths for the electron paths.

To be able to influence the width distribution of the phosphor areas, a light-absorbing element, namely a correction filter, is used in the light path which attenuates the light rays dependent upon their point of incidence on the screen.

In the prior art, this correction filter consists of a more or less close accummulation of graphite particles treated with gelatine and applied in the form of a coating to the lens.

This graphite-gelatine coating provides the intended attenuation of the light passing therethrough but also results in an undesirable change in the spectral distribution of this light.

The graphite-gelatine coating may be deposited either on the lens itself or on a special glass plate.

Exposure through such a filter gives phosphor areas on the screen which have the desired size but irregular edges. Furthermore, the coating on the filter in very sensitive and may be destroyed when touched.

The invention provides a method whereby these shortcomings are avoided. Special advantages of the deposited filter are that it withstands rough handling and is easily reproducible.

The novel method will now be explained in more detail. According to the invention, the correction filter is a transmission pattern consisting of a distribution of predominantly opaque spots formed by solidified spotlets applied to a transparent support, the concentration profile of which spots is chosen in accordance with the predetermined intensity distribution. The spots of predominantly opaque material are droplets having deposited from a mist of paint, for example. Such solidified droplets are about 5 to 100 $\mu$m in diameter. Their spacing and size are randomly distributed. According to its composition, e.g. graphite particles with a binder and a solvent, the solidified droplet is predominantly opaque. The desired transmission is obtained by varying the number of deposits per unit area. The solidified droplets are advantageously chosen to be so small that their projection from the screen-mask assembly on the light source is smaller than a few percent of the extent of the light source.

According to the invention, the droplets are different in size but, on a statistical average, give the desired intensity distribution; their number per unit area (density) corresponds to the desired intensity distribution. In the transmission range in question, the spot spacing is a multiple of the wavelength of the light used. Such a filter thus exhibits no spectral response. The light impinges on the screen unadulterated.

Such a filter is formed with a spray gun, but unlike in conventional spray-coating techniques, the paint is not applied in liquid form to the support, where a liquid film is formed which becomes increasingly thicker and, thus, more opaque as the spraying continues. In the invention, a paint is chosen which dries to opacity; after leaving the spray gun, it gathers into droplets which deposit in the form of closed spots.

The desired density or transmission can be obtained by moving the spray over the surface along straight or spiral lines, for example, the desired change in transmission being obtained by varying the rate of movement. The spray may also be released in a pulsed mode of operation, in which case the desired transmission of the respective zone requires a given number of pulses, so that the application takes place step by step and, hence, is controllable. It is also possible to measure the transmission while applying the paint, and to continuously compare the measured data with standard or desired transmission data so as to permit automatic operation.

It may be advantageous to limit the extent of the spray by using stencils, so that smaller areas will be treated on a selective basis. It is also possible to apply a method in which they spray hits the entire support, the desird grading of the transmission being established by exchanging the stencils and performing several spraying operations.

The invention will now be described with reference to the accompanying drawings, in which.

Figure 1:
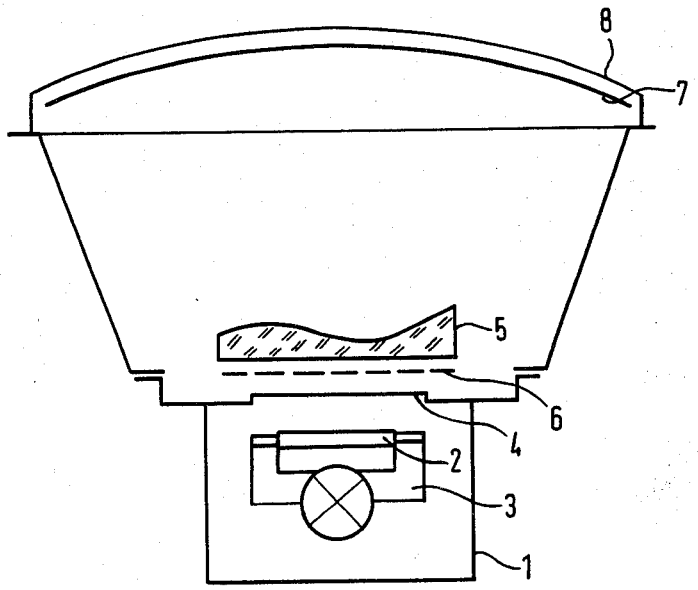
FIG. 1 shows the arrangement for exposing color-picture-tube screens in which the correction filter is used as the light-absorbing element.

FIG. 1 shows a "lighthouse" is used for exposing color-picture-tube screens. A housing 1 contains a rod-shaped light source 2. The latter is mounted in a holder 3, which also contains the power supply and cooling and adjusting facilities for the light source. The light emitted by the light source passes through a window 4. Below, above or on the lens 5 is a light-absorbing element 6, the correction filter. The light then falls through the shadow mask 7 on the phosphor-coated inside of the glass faceplate panel of the color-picture tube 8.

Figure 2:
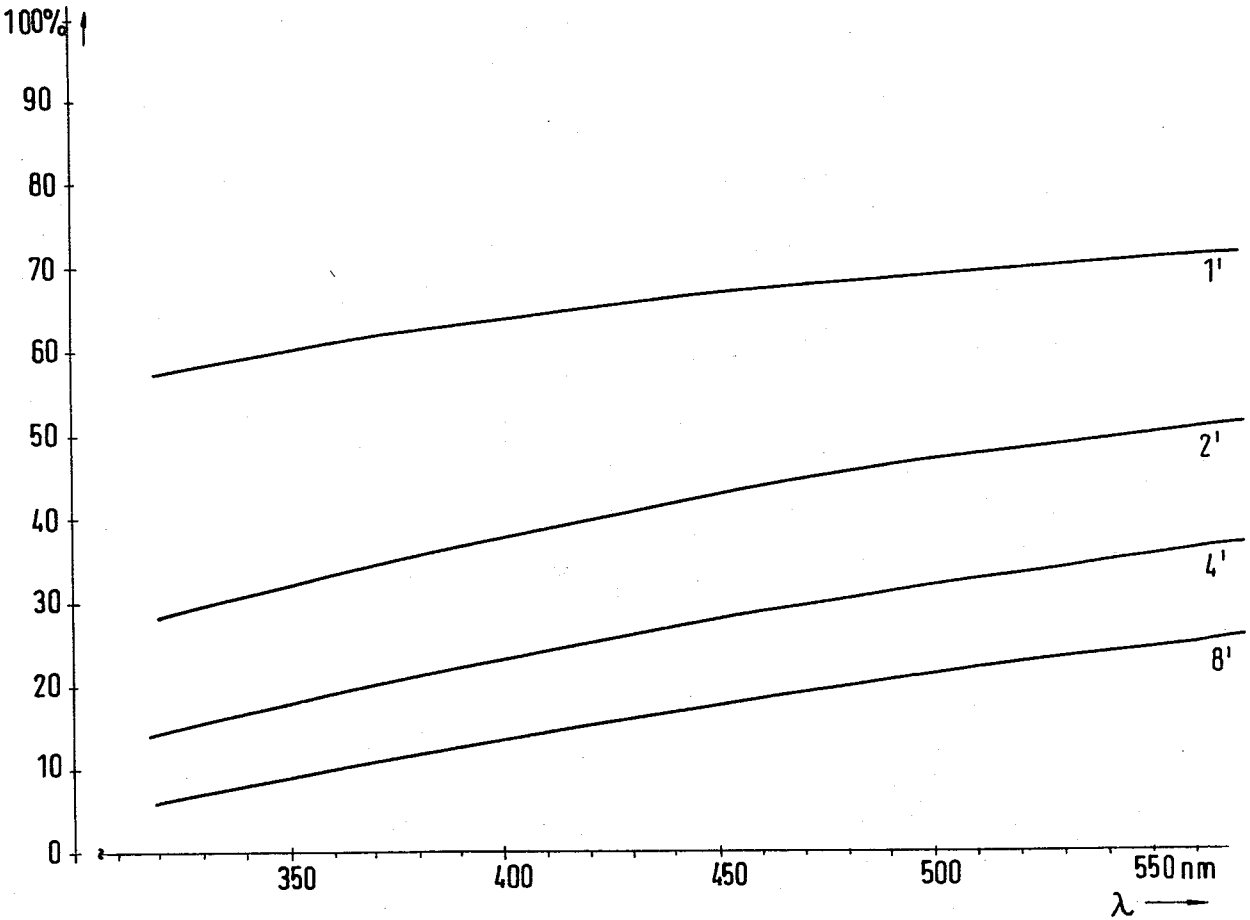
FIG. 2 shows transmission curves of prior art correction filters.

In prior-art correction filters, the transmission is dependent on the wavelength in the radiation spectrum from the light source 2, and this is undesirable. In FIG. 2, the transmission of four graphite-gelatine coatings of different thickness is plotted as a function of wavelength. The measured results show an increase in transmission with increasing wavelength and a change in the transmissions of the four coatings relative to one another.

Figure 3:
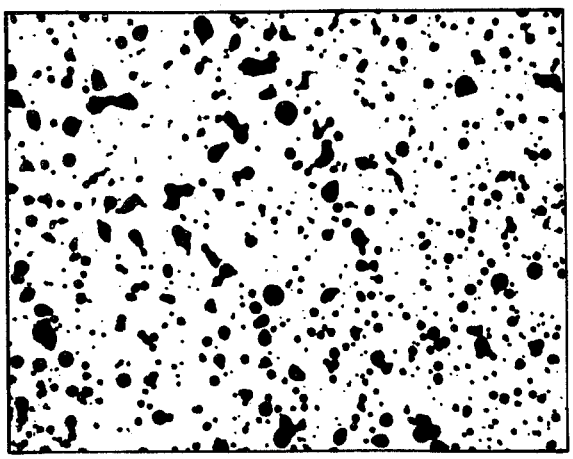
FIG. 3 is a greatly enlarged representation of a small area of the correction filter according to the invention.

The correction filter according to the invention does not exhibit this wavelength dependence, so that edge irregularities of the phosphor stripes are avoided. The opaque zones are spots about 5 to 100 $\mu$m in diameter part of which are formed as the liquid droplets of the mist of paint flow together upon hitting the surface of the filter. FIG. 3 is an enlarged representation of a small area with 90% transmission.

Figure 4:
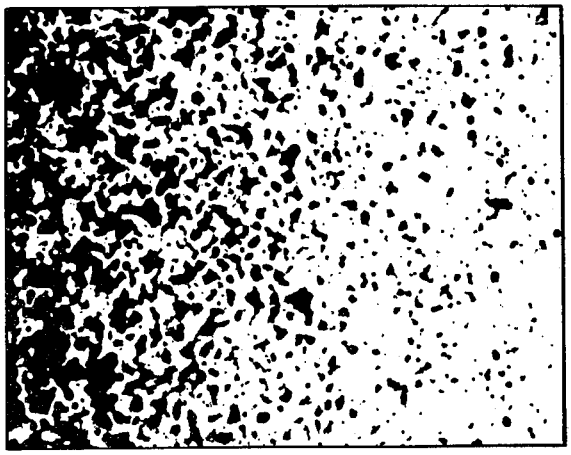
FIG. 4 is a greatly enlarged representation similar to that of FIG. 3 but with different light attenuation due to different spot density.

The intensity distribution on the surface of the correction filter is variable, which is achieved according to the invention by spraying, for example, with a moving spray, for different periods, through stencils, sequences of stencils, and moving stencils. FIG. 4 shows that the density can be varied even within a small area.

We claim:

1. A method of manufacturing a correction filter of the type that has a light-absorbing transmission pattern for generating, during the photochemical manufacture of the screen of a color-picture tube, a predetermined exposure intensity distribution over an area, said transmission pattern being formed by the step of:

applying to a transparent support a distribution of predominantly opaque spots formed by solidified droplets having a concentration profile chosen in accordance with the predetermined intensity distribution and achieved by using stencils.

2. A method of manufacturing a correction filter as described in claim 1, additionally comprising the step of spraying said droplets onto the transparent support.

3. A method as described in claim 2, wherein the droplets are formed by a paint of the type which, after emerging from a spray gun, gathers into droplets depositing in the form of closed spots and dries to opacity.

4. A method as described in claim 2, wherein the concentration profile is further controlled by moving the spray over the support along straight or spiral paths.

5. A method as described in claim 2, additionally comprising the step of releasing the spray in a pulsed mode of operation, in which case a desired transmission is achieved by a given number of pulses, the application of paint thus taking place step-by-step and hence being controllable.

6. A method as described in claim 5, wherein the process is continuous and the number of pulses is automatically controlled by measuring the filter transmission and comparing the measured transmission with desired transmission.

7. A method as described in claim 2, wherein the desired grading of the transmission is established by exchanging the stencils and performing several spraying operations.

8. A method of manufacturing a correction filter of the type that has a light-absorbing transmission pattern for generating, during the photochemical manufacture of the screen of a color-picture tube, a predetermined exposure intensity distribution over an area, said transmission pattern being formed by the step of:

applying to a transparent support a distribution of predominantly opaque spots formed by solidified droplets having a concentration profile chosen in accordance with the predetermined intensity distribution and achieved by performing several spraying operations.

9. A method as described in claim 8, wherein the droplets are formed by a paint of the type which, after emerging from a spray gun, gathers into droplets depositing in the form of closed spots and dries to opacity.

10. A method as described in claim 8, wherein the concentration profile is further controlled by moving the spray over the support along straight or spiral paths.

11. A method as described in claim 8, additionally comprising the step of releasing the spray in a pulsed mode of operation, in which case a desired transmission is achieved by a given number of pulses, the application of paint thus taking place step-by-step and hence being controllable.

12. A method as described in claim 11, wherein the process is continuous and the number of pulses is automatically controlled by measuring the filter transmission and comparing the measured transmission with desired transmission.

13. A method as described in claim 8, wherein the extent of the spray is limited by the use of stencils.

* * * * *